US005494378A

United States Patent [19]

Hanson

[11] Patent Number: 5,494,378

[45] Date of Patent: Feb. 27, 1996

[54] PILING APPARATUS

[76] Inventor: Larry K. Hanson, 2731 Tucker La., Los Alamitos, Calif. 90720

[21] Appl. No.: 270,599

[22] Filed: Jul. 5, 1994

[51] Int. Cl.[6] ..... E02D 5/74

[52] U.S. Cl. ..... 405/244; 405/234; 405/237; 405/249

[58] Field of Search ..... 405/231, 244, 405/232, 234, 237, 249, 257

[56] References Cited

U.S. PATENT DOCUMENTS

| | | | |
|---|---|---|---|
| 1,265,164 | 5/1918 | Barry | 405/237 |
| 1,746,848 | 2/1930 | Bates | 405/237 X |
| 1,762,341 | 6/1930 | McPherson . | |
| 3,115,226 | 12/1963 | Thompson, Jr. . | |
| 3,222,842 | 12/1965 | Luedloff et al. . | |
| 3,324,666 | 6/1967 | Lee . | |
| 3,373,569 | 3/1968 | Backman . | |
| 3,432,977 | 3/1969 | Scholl . | |
| 3,621,663 | 11/1971 | Otani . | |
| 3,763,655 | 10/1973 | Galuska . | |
| 4,195,487 | 4/1980 | Fukushima | 405/257 |
| 4,637,757 | 1/1987 | Aagaard | 405/227 |
| 4,813,816 | 3/1989 | Simanjuntak | 405/244 |
| 5,039,256 | 8/1991 | Gagliano | 405/244 |

FOREIGN PATENT DOCUMENTS

| | | | |
|---|---|---|---|
| 1010103 | 6/1952 | France | 405/237 |
| 2034662 | 4/1971 | Germany | 405/237 |
| 2050292 | 5/1972 | Germany | 405/237 |
| 1732 | 5/1982 | WIPO | 405/234 |

*Primary Examiner*—John A. Ricci
*Attorney, Agent, or Firm*—Fulwider Patton Lee & Utecht

[57] ABSTRACT

A tubular piling pipe having a plurality of cantilevered perforations formed in the exterior wall of the pipe defined by individual bendable necks and carrying enlarged-in-cross section tabs at their free extremities to provide foundational support. The bendable necks have elastic limits such that an outward force of sufficient magnitude will permanently force the necks and respective tabs radially outward and into the surrounding soil such that the tabs define anchor fingers.

16 Claims, 3 Drawing Sheets

PILING APPARATUS

BACKGROUND OF THE INVENTION

1. Field of the Invention

The invention is generally related to pilings on which buildings and similar housing structures are supported.

2. Description of the Prior Art

Structures of current construction include multi-level buildings weighing many tons. In some geographic areas where such structures are built, soil does not have the desired consistency to alone support the weight of such structures. In these situations, some form of foundational support must be employed to combine with the surrounding soil or substrata to provide the necessary support for such structures.

Pilings are widely known in the construction field to provide support greater than would be the case for the underlying unassisted soil. However, the support force provided by the pilings depends on two factors, the friction forces applied to the vertical walls of the piling by the surrounding soil, and the upward force applied to the bottom face of the piling by the soil (the end force). Because the friction force applied to a typical piling is much less than the requisite amount of support a structure requires, the end force must therefore supply the difference. This difference is often of substantial magnitude and thus necessitating a sectional bottom area of a correspondingly large magnitude. This results in undesirably large construction costs due, in part, to the fact that greater driving forces are required for driving pilings with larger cross sections. Typically, massive and expensive machinery is required to bore pilot holes in the soil to act as receptacles for receipt of the pilings being driven. The resulting costs, in both labor and machine time for boring such large diameter holes can be significant. There is, therefore, a need for a piling providing large support forces, while at the same time reducing the cost of implementation. The present invention meets this need.

In the field of pilings having a means for increasing the friction forces to provide enough support for erecting a structure thereon, various different embodiments of such pilings have been known for a number of years, and by way of example, forms of such embodiments can be found in U.S. Pat. Nos. 1,762,341, 4,813,816, 3,763,655, 3,222,842, and 3,432,977.

The above mentioned prior art piling apparatus have some disadvantageous features associated with them. For example, most of the apparatus mentioned require substantial machine time in order to implement the friction force mechanisms. In many of the prior art embodiments, when the piling is driven to its desired depth, an actuator member must be driven through the piling to force support platforms radially outwardly to penetrate the surrounding soil. Other such prior art apparatus utilize explosive charges to force some form of support mechanism into position. However, when the charges are detonated, a somewhat large cavity is formed, requiring the installer to fill such a cavity with cement or similar substance to maintain the integrity of the piling.

As such, it may be appreciated that there continues to be a need for a piling device which provides a large amount of support force relative to its vertical and cross sectional areas, while at the same time being cost efficient in that the machine time required to implement such a piling is relatively small. The instant invention addresses such needs.

SUMMARY OF THE INVENTION

Briefly, and in general terms, the present invention includes a hollow pipe having upper and lower ends, configured with a peripheral wall formed with discrete perforations spaced throughout its length configured to define a plurality of longitudinally projecting anchor fingers. The respective fingers are carried at their proximate extremities by bendable necks and project longitudinally to form at their free extremities enlarged-in-cross section tabs normally recessed in the pipe wall while the piling is driven into the ground. A chain of explosive charges or a single primer cord extending the length of the pipe is strung along the interior of the pipe wall to position discrete charges inward of each respective tab to be detonated after the piling has been driven into position to bend the respective such necks to fan such anchor tabs radially outwardly to be embedded into the surrounding soil to provide a plurality of discrete support elements resisting vertical shifting of such piling relative to the soil.

Other features and advantages of the invention will become apparent from the following detailed description, taken in conjunction with the accompanying drawings which illustrate, by way of example, the features of the invention.

DETAILED DESCRIPTION OF THE PREFERRED EMBODIMENT

Figure 1:
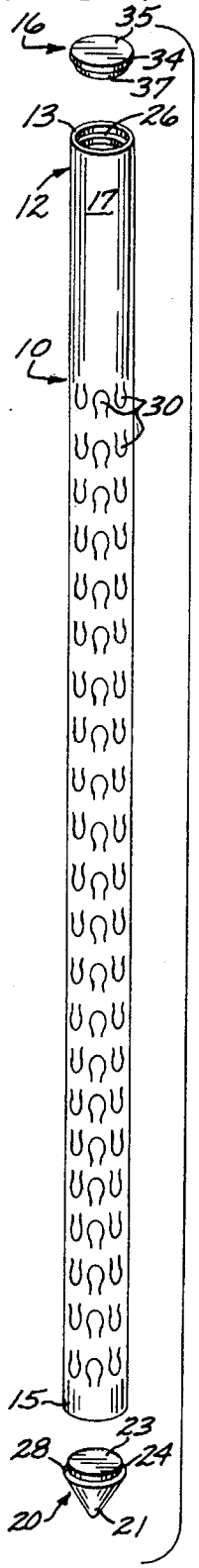
FIG. 1 is an exploded perspective view of an improved piling apparatus embodying the present invention.
Figure 2:
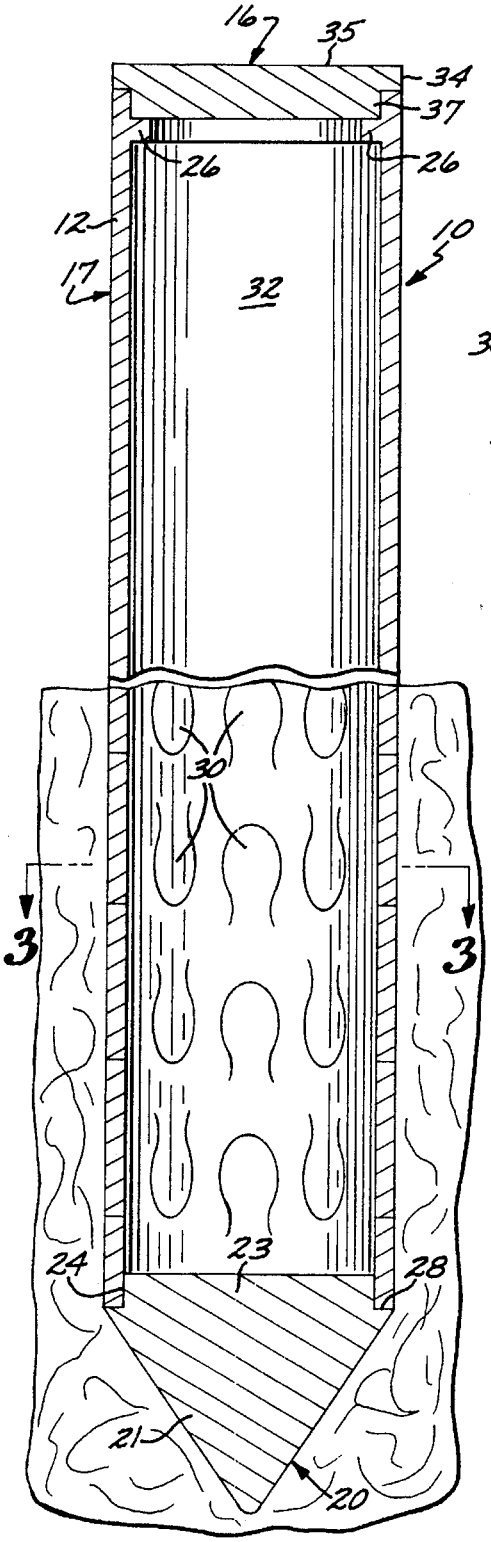
FIG. 2 is a broken vertical sectional view of the improved piling apparatus shown in FIG. 1 driven into support position.
Figure 3:
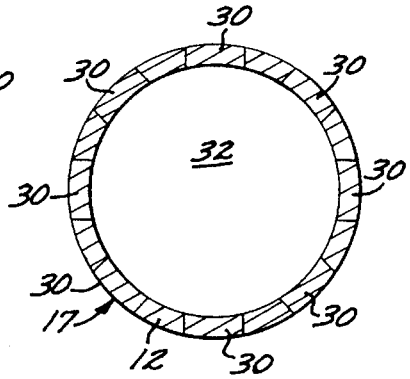
FIG. 3 is a horizontal sectional view taken along the line 3—3 of FIG. 2.
Figure 4:
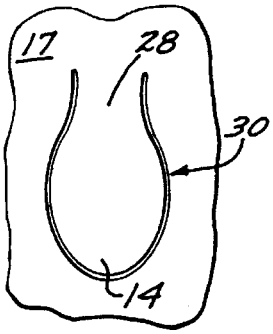
FIG. 4 is a partial side view, in enlarged scale, of the improved piling apparatus shown in FIG. 1 and showing a detail of the present invention.
Figure 5:
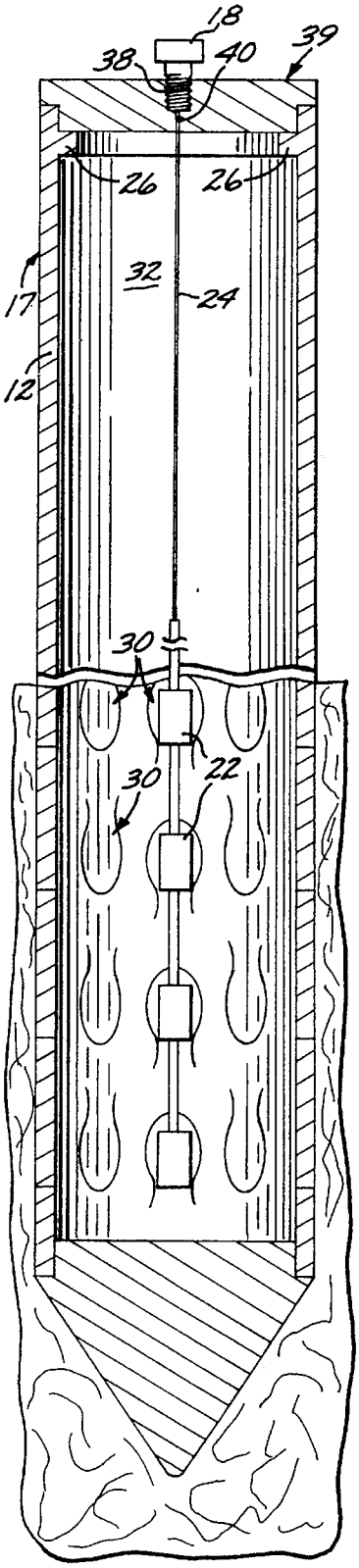
FIGS. 5 and 6 are broken views similar to FIG. 2 but showing, respectively, a string of explosives in position and the piling subsequent to detonation thereof.

In the following description, like reference numerals will be used to refer to like or corresponding elements in the different figures of the drawings. Referring now to the drawings, and particularly to FIG. 1, the high friction piling 10 of the present invention includes, generally, a hollow metallic pipe 12 forming a longitudinal cavity 32 therewithin and having an upper end 13 and a lower end 15 (FIGS. 1, 2 and 3). The peripheral wall 17 of the pipe has formed thereon a pattern of cantilevered anchor fingers 30 disposed diametrically in horizontal rows, reversely oriented, and defined by spoon shaped perforations machined into the exterior surface of the pipe. Such perforations are configured to form the respective anchor fingers with respective bendable tether necks 28 and terminate in enlarged-in-cross section anchor tabs 14 disposed at the distal ends thereof (FIG. 4). A chain of explosive discrete packet of charges 22 is disposed in the cavity such that the discrete charges 22 are located adjacent the inside surfaces of the respective anchor fingers (FIG. 5). The discrete charges may be replaced by a single primer cord (not shown) extending the length of the pipe and containing therewithin an explosive charge throughout the entire length of the cord.

The piling 10 may be driven into the support soil with the respective fingers 30 in their retracted positions disposed within the confines of the arcuate wall to be maintained recessed in vertical alignment within the piling wall to minimize the frictional resistance to driving thereof to its embedded support position. Once in position, and the charges placed adjacent the inside walls of respective anchor fingers, the charges themselves are detonated to generate explosive forces at the respective elevations of the horizontal rows of fingers thereby abruptly generating respective radially outwardly acting high pressures which will displace the distal ends of the respective fingers radially outwardly to bend the respective metallic necks beyond the elastic limit of the pipe metal thereby placing a permanent set in the respective necks and locking the tabs 14 in their extended position shown in FIGS. 6 and 7, thereby substantially enhancing the gripping power of the piling to enhance the support force provided thereby.

The piling pipe 12 may be of cylindrical thick walled metallic construction such as ¼"–½" carbon steel and may be integrally formed or welded together at the construction site to provide the selected overall length for the particular application. The wall thickness may be selected of the dimension which will carry the compressive load forces to provide the desired support and which will provide the respective necks 28 for the particular configuration with sufficient body to, when the explosive force of the respective integral charges 22 bend such necks to deploy the respective anchor fingers, allow for such deployment under the force applied to enable the metal material within the neck to exceed its elastic limit to thereby provide respective permanent bends to maintain such fingers in the deployed positions shown in FIGS. 6 and 7 and to provide the desired resistance to further outward and longitudinal bending of the distal ends of the respective fingers to thereby cooperate with the overall array of fingers to resist vertical shifting of the piling in the surrounding soil under the respective design loads.

The pipe 12 is open at its top end and includes a recessed annular drive collar 26 defining a cylindrical cavity into which a drive cap, generally designated 16, will nest. The drive cap includes a circular plate 35 undercut on its bottom side to define an annular flange 34 which overlies the top edge of the pipe 12 and further defines a downwardly projecting cylindrical plug 37 configured to nest in the cavity counter bore formed by the top end of such pipe and to position the downwardly facing outer surface thereof in confronting relationship on the top side of the annular collar 26.

Referring to FIG. 5, a closure plate 39 is constructed similar to the plate 16 and is formed centrally with a threaded electrical connector bore 38 having a reduced-in-diameter electrical conductor bore 40 extending downwardly therefrom for extension of an electrical lead 24. An electrically conductive connector stud 18 is screwed into the threaded bore 38 and connects with a downwardly depending electrically conductive lead 24 projecting downwardly therefrom and carrying the respective charge packets 22 spaced along the length thereof in spaced relationship for positioning at the annular elevations of the respective horizontal rows of anchor fingers.

The pipe 12 is also open at its bottom end 15 and a conical driving penetration point 20 is provided for mounting in covering relationship thereover. The penetration point 20 is in the form of an arrowhead shaped conical body 21 having a machined annular recess 24 formed about the upper periphery thereof to define a reduced-in-diameter neck 23 and upwardly facing annular shoulders 28. The neck 23 is configured to be slidably received in the lower end of the pipe and may be welded in position.

The anchor fingers 30 are arranged in horizontal rows and vertical columns disposed in alternately oriented upwardly and downwardly depending cantilevered configuration to thereby, when deployed, provide the desired support against vertical upward or downward shifting of the piling under various loads which may include various forces exerted on the supported structure such as by wind, variable weight loadings and even seismic displacement of various structural loads and possibly even various portions of the support soil.

The anchor fingers 30, for a conventional piling of about 12 inches in diameter, may be about 3-½ inches long and about 1-½ inches wide at their widest point. The respective necks may be about one inch wide. The population density of the respective fingers is preferably on the order of about 10 in each horizontal row and arranged in a vertical density of about two for each vertical foot. This construction then provides a plurality of uniform frictional holding forces disposed over a substantial length and throughout the peripheral area of the respective pilings in the respective support soil in which they are embedded. This then provides enhanced anchoring of the pilings within the soil to provide enhanced support.

In operation, it will be appreciated that the respective pilings may be transported to the construction site in individual lengths and the respective lengths of piling pipes welded together at the construction site to provide the desired composite length for the various pilings. The penetration point 20 is positioned in the bottom end 15 of the composite length of pipe and welded into position. The drive cap 16 may then be positioned over the top end of the composite piling and tack welded in position or fastened by some other method with the plug 37 nested on the top of the drive collar 26. Depending on the soil or other subterranean structure and pile driving technique, a pilot bore may be bored in the soil and the piling then erected over the pilot bore and the pile driver moved into position to hammer against the drive cap 16. The piling will thus be driven to the desired vertical elevation.

Figure 6:
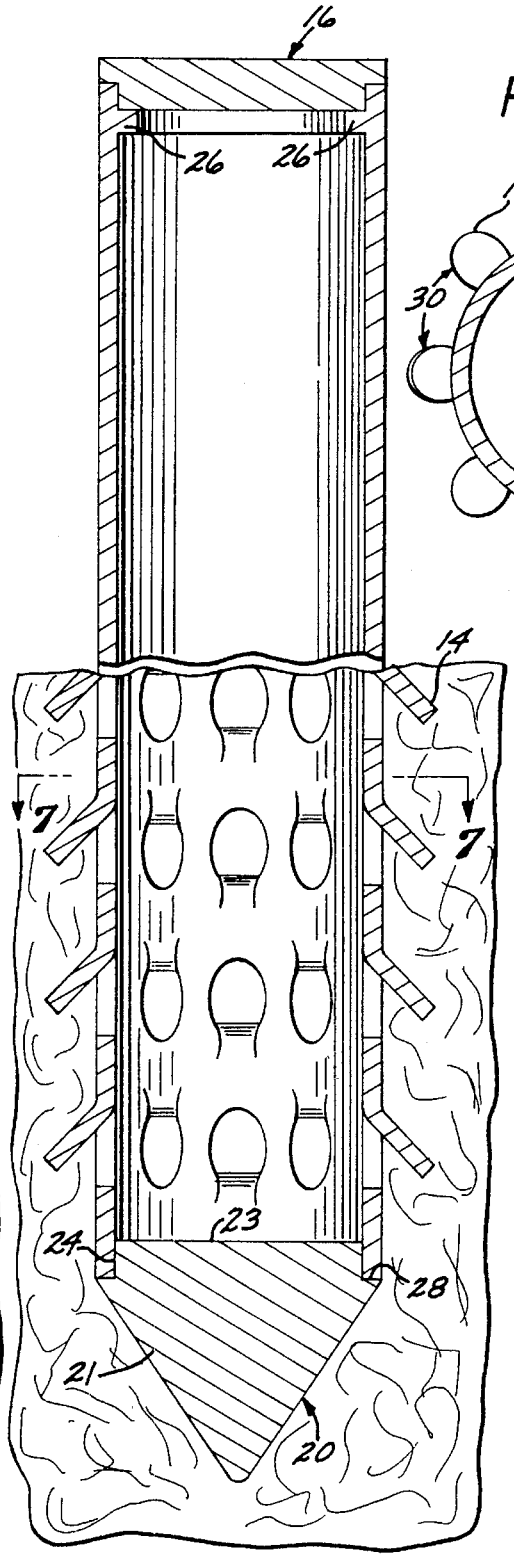
Figure 7:
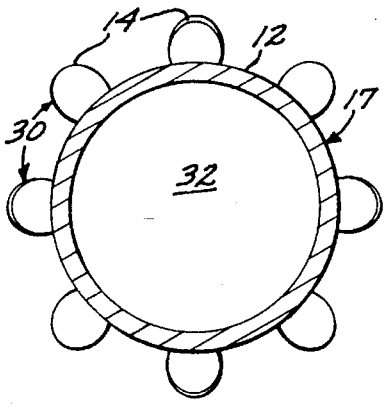
FIG. 7 is a horizontal sectional view taken along the line 7—7 of FIG. 6.

Referring to FIG. 5, the electrical conductor bore 40 and the threaded electrical connector bore 38 may then be formed in the drive plate 16 or, in some embodiments, will have been preformed in a cap 39 and plugged during the pile driving procedure. In that embodiment, the tack weld or other fastener for the drive plate 16 may be cut and the drive plate 16 removed and replaced by the deployment cap 39 having the threaded electrical connector bore 38 and electrical conductor bore 40 already pre-bored. In all of these embodiments described, the electrical conductor 24 may be threaded upwardly through the electrical conductor bore 40 and the connector stud 18 then screwed into position. The length of the lead 24 may be adjusted to position the respective charge packets 22 or the single primer cord at the elevation of the respective horizontal rows of fingers 30. An electrical activator (not shown) may then be connected to the connector stud 18 and the activator excited to detonate the respective charge packets 22. Such detonation will then serve to generate high localized explosive pressure in the proximity of the respective rows of anchor fingers 30 thus applying high outwardly acting radial pressures to the respective anchor tabs 14 of the respective anchor fingers thereby driving such tabs radially outwardly to the respective position shown in FIG. 6 angling outwardly at respective angles of about 30°–45° to the center line of the piling. Driving of such tabs radially outwardly to that extent will cause the respective necks 28 to be bent beyond their elastic limit thus causing such tabs to take the preset outwardly angled configuration shown to be embedded in the soil thereby resisting vertical shifting of the piling. If desired, the interior 32 of the piling may be filled with filler such as concrete or other filler material. In any event, after detonation, the deployment cap 39 may be removed and replaced with the drive cap 16 to be welded onto the upper end 13 to provide a planar foundational support area (FIG. 6). In the event of subsequent loading of the piling or tendency of the load thereon to shift or of the soil to shift, relative vertical movement of such piling within the surrounding soil will be resisted by the outwardly angled tabs 14. Such tabs, being oriented at respective alternating upwardly and downwardly angled orientations, serve to provide for alternate compression and tension loading thereof. It has been found that by providing such close spaced points of individual anchoring serves to not only break the overall load into numerous small loads but, employing such anchor fingers arrayed in alternately angled orientations, provides for position of a number of such fingers at the level in the piling most effective to carry any one of a great number of differently acting loads that may be applied thereto.

Figure 8:
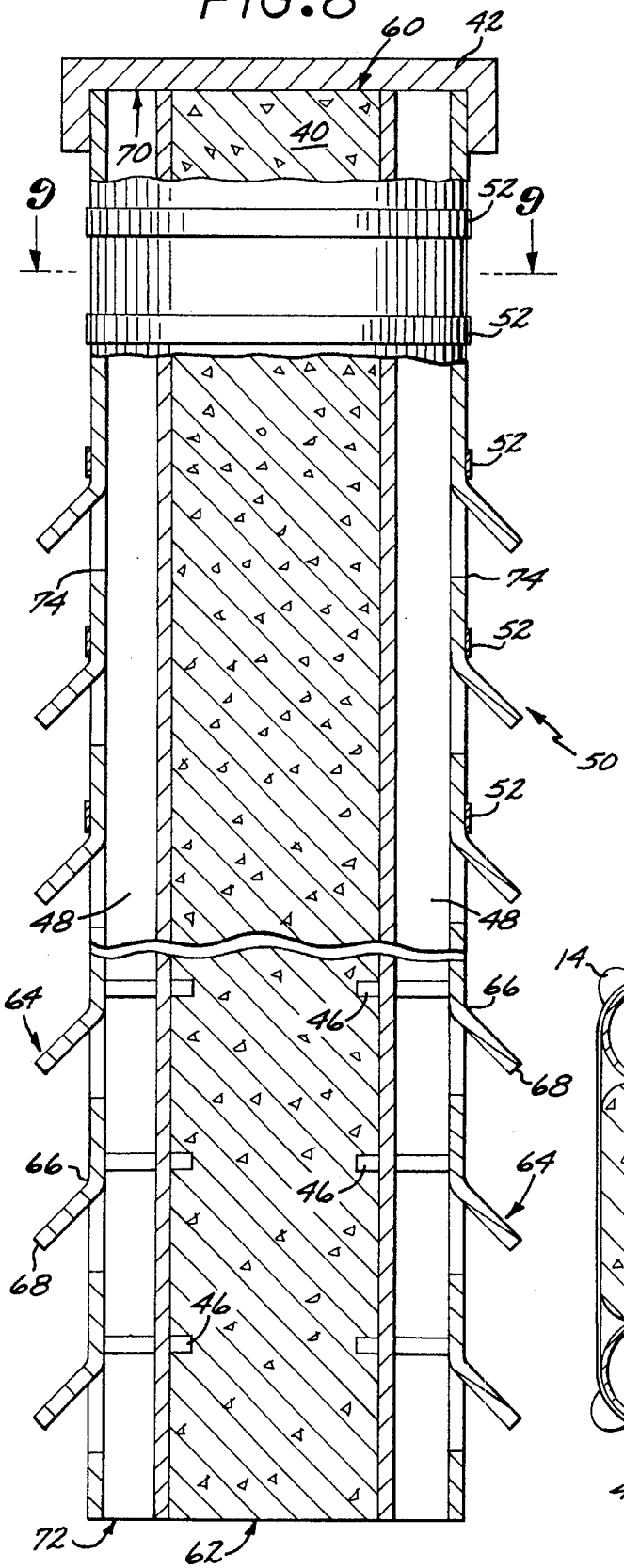
FIG. 8 is a vertical view of a second embodiment of the improved piling apparatus of the present invention after detonation of the explosive charges.
Figure 9:
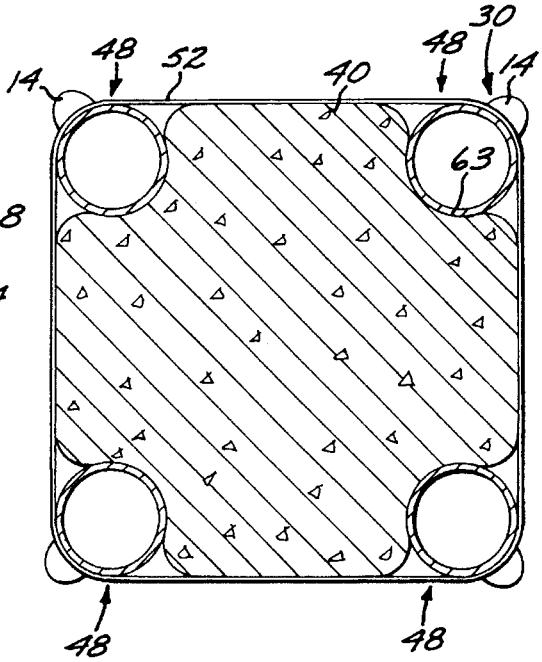
FIG. 9 is a horizontal sectional view of the improved piling apparatus shown in FIG. 8.

Referring to FIGS. 8 and 9, a second embodiment of the piling of the present invention shown is generally designated 50 and includes, generally, an elongated concrete column 40 having an upper end 60 and a lower end 62. The column has a generally square cross sectional shape with outwardly opening, semi-circular channels 63 disposed at the four corners thereof and extending the length of the column. Tubular pipes, generally designated 48, are formed with peripheral cylindrical walls 74 to define longitudinal cavities 72 and are nested in the respective longitudinal channels. The pipes 48 may be attached to the column by means of a plurality of vertically spaced annular bands 52 which encompass the periphery of the pipes and column at various elevations to securely attach the pipes to the column. The respective pipe walls 74 are formed on the exposed surfaces opposite the respective channels with at least one vertical column of cantilevered anchor fingers 64. Such anchor fingers 64 have the same design and characteristics as the anchor fingers 30 of the first embodiment described hereinabove. A chain of explosive charges or a single primer cord (not shown) may be disposed in the inner cavity of each pipe such that the respective discrete charges are located adjacent the inside surfaces of the respective anchor fingers.

The piling may be driven into the soil with the respective anchor fingers 64 in their recessed position normal to the surface of the pipe wall, such anchor fingers to remain recessed in vertical alignment with the piling wall to minimize frictional resistance while driving such piling into its embedded position. Once in position, the respective chains of explosive charges or primer cords are placed within each of the inner cavities 72 of the respective pipes 48 detonated, thereby generating explosive forces at the elevations of the respective fingers to thereby force the respective necks 66 outwardly about respective bend lines formed in the respective necks beyond their respective elastic limits to permanently lock the respective tabs 68 in their extended positions as shown in FIGS. 8 and 9 to thereby provide the desired increased foundational support.

The concrete column 40 may be formed of pre-stressed concrete and may have a selected thickness and length which will carry the compressive load forces to cooperate with the anchor fingers to provide the desired amount of foundational support.

A driving cap 42 is employed to aid in embedding the piling 50 into the soil to the desired vertical elevation. The driving cap is formed with a square top end having a diameter larger than that of the piling and downwardly projecting side walls to encompass the upper end of the piling. The driving cap is releasably attached to the upper end before embedding the piling into the soil and may be removed once the piling attains the desired placement.

In operation, the pilings 50 are transported to the construction site to be implemented in the soil. The driving cap 42 is positioned over the upper end 60 of the piling and is forced downwardly onto the piling to releasably yet securely attach to the upper end of the piling. The driving cap may also be tack welded at its respective corners to the respective pipes 48 once it is forced onto the upper end or may be clamped or attached to the upper end by some other means. Depending on the soil and pile driving technique, a pilot bore may be bored in the soil and the piling then placed over such bore and the pile driver moved into position to hammer against the driving cap 42, thereby driving the piling to the desired vertical elevation.

Once the piling attains its embedded position, the driving cap 42 is removed, thereby exposing the top ends 70 of the respective pipes 48. Respective chains of explosive charges or a primer cord (not shown) may then be placed inside the cavities of the respective pipes and held in suspended position by means of respective caps attached to the chains of charges which releasably attach to the top ends of the respective pipes such that respective discrete charges are disposed at elevations adjacent the inside surfaces of respective anchor fingers 64. The chains of explosive charges may then be detonated by means of an activator (not shown). Such detonation will serve to generate a momentary high localized, outwardly acting explosive pressure to the inside surfaces of the respective anchor tabs 68, thereby driving such tabs radially outward to their respective positions shown in FIGS. 8 and 9 angling outwardly and downwardly at about 30°–45° to the center line of the piling. The driving of such tabs outward to that extent will cause the respective necks 66 to bend beyond their respective elastic limits such that the respective tabs will be held permanently in the outwardly angled configuration as shown in FIGS. 8 and 9, to thereby be embedded in the surrounding soil to resist further vertical shifting of the piling. It will be appreciated that soil displaced outwardly by outward movement of such fingers will, in many cases, fill back inwardly around such fingers to hold the respective fingers against vertical shifting. In the event of subsequent loading of the piling or tendency of the load thereon to shift or of the soil to shift, relative elevational movement of the piling within the surrounding soil will be resisted by the combined resistance of the overall structure assisted by the combined anchoring forces applied to the respective outwardly angled tabs 68. Such tabs, being oriented outwardly and downwardly, are loaded with a combination compression and shear load to thus cooperate with the concrete column to provide a high degree of support for the load applied to the piling apparatus.

From the foregoing, it will be appreciated that the high piling apparatus of the present invention, while being relatively small, serves to provide a high degree of foundational support. The relatively small size of the piling reduces not only manufacturing costs but machine time and labor costs required to implement such a support system. Furthermore, because the pilings provide more support than a conventional piling, fewer high friction pilings are required in order to support a given building. This further compounds the reduction of labor and machine time to install such a support system. Although the high piling apparatus of the present invention has been shown to be used for increasing foundational support, it will be appreciated that the present invention may also be used as an anchor for guy wires or similar support wires which are used to brace bridges or other structures to the ground.

While several forms of the invention have been illustrated and described, it will also be apparent that various modifications can be made without departing from the spirit and scope of the invention. Accordingly, it is not intended that the invention be limited, except as by the appended claims.

What is claimed is:

1. An improved piling apparatus comprising:

an elongated tubular piling constructed with an elongated malleable peripheral holding wall of a predetermined thickness;

said holding wall being formed with contoured perforations arranged in a selected pattern extending throughout its length to form respective longitudinally projecting anchor fingers normally disposed within the extension of the plane of the body of said wall and configured with respective relatively narrow necks and respective relatively wide friction tabs cantileverly carried from the respective said necks; and said necks being bendable beyond their respective elastic limits to assume respective set configurations to angle the respective said fingers longitudinally outwardly to be embedded in soil surrounding the said holding length.

2. Improved piling apparatus as set forth in claim 1 wherein:

said piling is constructed of carbon steel.

3. Improved piling apparatus as set forth in claim 1 wherein:

said perforations are in the form of cut lines configured to form said friction tabs in the shape of respective ovals.

4. Improved piling apparatus as set forth in claim 1 wherein:

the respective said fingers are spoon shaped to form respective narrow necks and wide friction tabs.

5. Improved piling apparatus as set forth in claim 1 wherein:

said fingers are configured with a length of substantially 3–½ inches.

6. Improved piling apparatus as set forth in claim 1 wherein:

said perforations are formed to position the respective said fingers three to a linear foot of said holding length.

7. Improved piling apparatus as set forth in claim 1 wherein:

said holding wall is configured with said perforations arranged to form said anchor fingers arranged in longitudinal columns with the fingers of adjacent columns, when deployed, angling outward in opposite longitudinal directions.

8. Improved piling apparatus as set forth in claim 1 wherein:

said holding wall is formed with said perforations arranged in a pattern forming a plurality of vertical columns.

9. Improved piling apparatus as set forth in claim 1 that includes:

a predetermined number of said tubular pilings, each including an elongated nest side and each formed with a side opposite said nest side with at least one vertical column of said perforations; and an elongated central column formed with a predetermined number of longitudinal outwardly facing channels for nesting thereonto of the respective said nest sides of the respective said pilings.

10. Improved piling apparatus as set forth in claim 9 wherein:

said support column is constructed of concrete.

11. Improved piling apparatus as set forth in claim 9 wherein:

said support column is of substantially square cross section with a said nest channel disposed at each of the four corners.

12. Improved piling apparatus as set forth in claim 9 that includes:

tie straps surrounding said pilings to tie them into place nested in said channels.

13. Improved piling apparatus as set forth in claim 9 wherein;

said perforations are spoon shaped.

14. Improved piling apparatus comprising:

an elongated support column formed with a plurality of longitudinal outwardly opening nesting channels disposed equidistant thereabout;

a plurality of elongated tubular pilings constructed with elongated walls defining on the respective one lateral sides with a nesting surface for receipt in a respective one of said channels and on the respective opposite side with respective malleable holding walls;

said holding walls being formed with contoured perforations arranged in at least one respective vertical column and each configured with respective malleable cantilever necks and extending anchor tabs;

said necks being bendable to respective angles sufficient to exceed their respective elastic limits to each assume a permanent bend angling the respective anchor tabs longitudinally outwardly; and tie straps surrounding said pilings and columns to structurally tie said pilings to said column.

15. Improved piling apparatus according to claim 14 wherein:

said column is constructed of cement.

16. A method of stabilizing the support of a structure on underlying soil including the steps of:

selecting an elongated tubular piling having a longitudinal malleable peripheral holding wall formed with contoured perforations defining anchor fingers with respective narrow necks and respective relatively wide anchor tabs cantileverly carried from the respective said necks;

driving said piling into said soil to a predetermined depth;

placing an explosive inside said piling; and detonating said explosives to bend the respective said anchor fingers at the respective said necks past their elastic limits and to force the respective said anchor tabs radially outwardly into said soil thereby locking said anchor fingers in place.

* * * * *